United States Patent [19]

Kusakabe et al.

[11] 4,096,890

[45] Jun. 27, 1978

[54] WOVEN FABRIC UTILIZING A PARTICULAR TEXTURED YARN AND METHOD FOR MANUFACTURING THE SAME

[75] Inventors: Haruhiko Kusakabe; Masashi Makita; Masutoshi Ueda, all of Otsu, Japan

[73] Assignee: Toray Industries, Inc., Tokyo, Japan

[21] Appl. No.: 802,523

[22] Filed: Jun. 1, 1977

Related U.S. Application Data

[63] Continuation-in-part of Ser. No. 630,753, Nov. 10, 1975, abandoned.

[30] Foreign Application Priority Data

Nov. 12, 1974 Japan ..... 49-129556
Nov. 12, 1974 Japan ..... 49-129557

[51] Int. Cl.[2] ..... D03D 47/28
[52] U.S. Cl. ..... 139/435; 57/157 TS
[58] Field of Search ..... 139/1, 11, 35, 429, 139/435; 57/157 F, 157 TS, 140 R, 140 J

[56] References Cited

U.S. PATENT DOCUMENTS

| | | | |
|---|---|---|---|
| 3,529,413 | 9/1970 | Marrinan et al. | 57/140 R |
| 3,814,141 | 6/1974 | Iribe et al. | 139/435 |
| 3,946,548 | 3/1976 | Hino et al. | 57/140 J |
| 3,955,351 | 5/1976 | Jones et al. | 57/157 TS |

*Primary Examiner*—Henry S. Jaudon
*Attorney, Agent, or Firm*—Armstrong, Nikaido, Marmelstein & Kubovcik

[57] ABSTRACT

A woven fabric formed by utilizing an interlaced false twisted yarn as the warp and the process for producing such woven fabric. The interlaced yarn as the warp has such a particular configuration that the collectness of the yarn can be effectively maintained during the weaving operation and, therefore, pilling of the individual filaments and snagging can be effectively prevented, and the sizing of the warp can be omitted. Since the interlaced yarn of the invention is effective bulkiness even if the superior collectness is provided, any possible slip of yarns from the crossing point between the warp and the weft can be effectively prevented. Consequently, fabric having a low yarn density can be easily produced. When the above-mentioned fabric is woven, the warp is wet at a weaving zone between the healds and cloth-fell defined by the beating motion of the reed. Accordingly, a water jet loom is preferably utilized to produce the woven fabric of the present invention. For eliminating the problem of jet soil, preferable treating agents which are selectively applied to the multifilament yarn for producing the interlaced yarn of the present invention are disclosed.

5 Claims, 10 Drawing Figures

WOVEN FABRIC UTILIZING A PARTICULAR TEXTURED YARN AND METHOD FOR MANUFACTURING THE SAME

This application is a continuation-in-part of U.S. application Ser. No. 630,753, filed Nov. 10, 1975 now abandoned.

SUMMARY OF THE INVENTION

The present invention relates to a woven fabric utilizing a textured yarn, particularly a textured, fluid jet interlaced yarn comprising a plurality of continuous synthetic thermoplastic filaments. The woven fabric according to the present invention has a high resistance to pilling or snagging, or the slipping of component yarns from the respective crossing points of warp and weft yarns, without loss of the bulkiness of a textured yarn. The present invention further relates to a method for manufacturing the above-mentioned woven fabric.

It is well-known that the bulkiness of a woven fabric utilizing a textured yarn is reduced if such textured yarn, to which additional twists are imparted, is utilized as a material yarn. In such woven fabric, there is the possibility of the yarn slipping from the crossing points of the warp yarn and the weft yarn. In a case where a so-called interlaced multifilament yarn, which is produced by the fluid jet interlacing treatment, is utilized as a material yarn for producing the woven fabric, pilling or snagging frequently occurs so that the weaving efficiency is reduced and the appearance of the fabric is damaged. The principal object of the present invention is to improve the quality of the woven fabric utilized a particular textured yarn, wherein the woven fabric is provided with an excellent bulkiness, and a high resistance to pilling and snagging.

The other object of the present invention is to provide a unique method for producing the above-mentioned woven fabric.

To attain the above-mentioned purpose of the present invention, there are the basic requirements that, firstly, the textured yarn utilized as the material yarn for producing the woven fabric according to the present invention should be an interlaced yarn provided with an original twist or without twist; secondly, the above-mentioned interlaced yarn has a particular configuration defined by a ratio of interlacing in a range between 200 and 70 after finishing the woven fabric, and; thirdly, the above-mentioned woven fabric contains the above-mentioned interlaced yarn in a percentage of at least 50 weight percent per unit area of the woven fabric.

According to our research, it was found that a false twisted yarn is preferably used for making the above-mentioned interlaced textured yarn. However, if the false twisted yarn processed by the interlacing treatment does not satisfy the above-mentioned basic requirements, such interlaced yarn has bulky portions having loops or loose individual filaments projected outward from the main body of the yarn similar to the textured yarn identified by the well-known trademark "Taslan". According to our research, even if the false twisted yarn is used as a material yarn for the purpose of the present invention, it is essential that the interlaced yarn made from the false twisted yarn have such a configuration that the bulkiness of the interlaced portions is not substantially increased in comparison with the material false twisted yarn. That is, the increase of the bulkiness is less than a few percent. Further, it is essential that such interlaced portions be capable of separating into individual filaments in a free condition, but be almost incapable of separating into individual filaments during additional processing, such as the dyeing of the interlaced yarn or the weaving or finishing operation of the woven fabric, or even when the garments made from the woven fabric according to the present invention are used.

For the sake of simplification of the following explanation, the above-mentioned interlaced yarn utilized for producing the woven fabric according to the present invention is hereinafter referred to as the interlaced yarn of the present invention.

We have confirmed that, even though the interlaced yarn of the present invention is provided with interlaced portions having poor bulkiness, the woven fabric of the present invention has increased thickness and bulkiness, as well as superior resistance against pilling and snagging, even though the interlaced yarn of the invention is provided with the original twist or without twist. Further, we have confirmed that, the woven fabric of the present invention has the superior property that the slip of the warp yarns or weft yarns from the crossing points thereof is effectively prevented. Such property is distinguished from a woven fabric utilizing a twisted multifilament yarn. When a yarn different from the interlaced yarn of the present invention is utilized together with the interlaced yarn of the present invention for producing a woven fabric, if such other yarn is a non-twisted yarn, the above-mentioned characteristic feature of the woven-fabric according to the present invention is effectively created. However it must be noted that a desirable effect can be created even though a yarn provided with twists is utilized together with the interlaced yarn of the present invention for producing the woven fabric.

DETAILED EXPLANATION OF THE INVENTION

The interlaced yarn utilized for producing the woven fabric according to the present invention will first be explained in detail.

Multifilament yarn of synthetic filaments, such as a polyester multifilament yarn or polyamide multifilament yarn, is used as a material for producing the woven fabric according to the present invention. It is preferable that a false twisted yarn having bulkiness be utilized for producing the interlaced yarn of the present invention. The thickness of the material yarn is selected within a range of 30 to 500 denier, appropriately depending on required weight and thickness of the resulting fabric. In the false twisting treatment, various yarns differing in crimp characteristics can be prepared, and yarns having crimp characteristics suitable for the required characteristics in the resulting fabric are used. These false twisted yarns are subjected to the fluid treatment using air, whereby individual filaments of the multifilament yarn are entangled and crosslinked with one another and the desired interlaced effect is attained. The degree of interlacing of the individual filaments is so selected that the interlacing factor defined hereinafter is within a range of from 70 to 200. The structure of the interlaced yarn of the present invention is different from the structure of the conventional bulky yarn in which individual filaments are entangled with one another by forming irregular slacks or loops of individual filaments of the multifilament yarn and the bulkiness is given by this entanglement. The interlaced yarn of the present invention is characterized by the fact that there is no substantial increase of the bulkiness at the interlaced portions, and if any it is within several percent, and these interlaced portions can be separated into individual filament in free condition.

The false twisted yarn subjected to the above interlaced treatment according to the present invention is characterized by the fact that the interlaced yarn in a fabric after the finishing treatment has such a degree of interlacing, which is hereinafter represented by CF value, that the CF value defined below is within a range of from 70 to 200.

Figure 1:
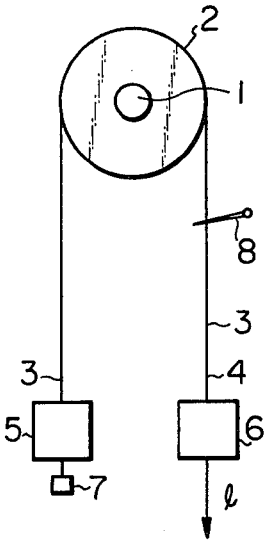
FIG. 1 is a schematic side view of an instrument for measuring the CF value of the textured multifilament yarn.

The method of measuring the CF value, which indicates the degree of interlacing, will now be described by referring to FIG. 1.

A test piece 3 to be measured is hung on a grooved pulley 2 capable of rotating right and left under no resistance around a central axis 1, and the test piece is fixed so that it does not slip on the pulley 2. Initial loads 5 and 6 of the same weight are attached to the two ends of the test piece, respectively. The initial load is adjusted to the total denier of the sample multiplied by 0.2 grams. Within a certain portion of the test piece, all of the individual filaments are roughly divided into two groups at an area of the lowest degree of cross-linking, and a cotton thread needle 8 is pierced between the two groups of the individual filaments. A constant load 7 of a weight corresponding to the individual filament's denier multiplied by 1 gram is imposed on the initial load 5 hung on the left side (in FIG. 1) of the test piece 3. Then, the test piece is moved to the left (in FIG. 1) by the constant load 7 until an entangled part is caught by the needle 8 piercing the intermediate point and the sample does not move further. Then, the constant load 7 is disconnected from the initial load 5 and is imposed on the right (in FIG. 1) initial load 6 to move the test piece 3 to the right (in FIG. 1) by the constant load 7 until an entangled part is caught by the needle 8 and the test piece does not move further. The length $l$ in cm of movement of the test piece at this point is measured and the CF value is calculated from the following equation.

$$CF = 100/l$$

Since there can be a considerable deviation among the thus determined CF values, it is necessary to repeat the test at least 20 times and obtain an average value.

The structure of the woven fabric of the present invention will now be described.

It is an indispensable requirement that the abovementioned interlaced yarn should be involved in the woven fabric in an amount of at least 50% by weight in any one area of the fabric. The interlaced yarn may be woven into a fabric according to various methods. For example, the interlaced yarn may be used for all of the warps and wefts or it may be used only for either the warp or weft. Further, this interlaced yarn may be arranged in parallel to another yarn alternately at a prescribed interval in the warp or weft. In any case, however, it is indispensable that the interlaced yarn should be in an amount of at least 50% by weight in any one area of the fabric, whereby the thickness and bulkiness characteristics of the woven fabric are highly improved. Yarn that can be used in combination with the interlaced yarn of the present invention are not particularly critical. For example, twisted or non-twisted multifilament yarns may be used together with the interlaced yarn of the present invention, however, when untwisted textured multifilament yarn is employed together with the interlaced yarn according to the present invention, the effect of improving the thickness and bulkiness characteristics according to the present invention is enhanced.

Any of three fundamental structures of woven fabric such as plain weave, twill weave and satin weave, and modifications of these weave structures can be optionally adopted for the fabric in the present invention. The density of the woven fabric of the present invention may optionally be determined appropriately in view of the required properties of the fabric. Since the possibility of the yarn slipping in the woven fabric is very much reduced in comparison with the conventional woven fabrics utilizing a textured yarn having the compact effect imparted thereto by twisting, the density may be reduced so as to make the most use of the characteristics of the yarn.

The degree of interlacing in the interlaced yarn is reduced to some extent by the dyeing process. Accordingly, in the present invention, the degree of interlacing is defined with respect to yarn which has been subjected to the dyeing process. More specifically, in the present invention, the dyed woven fabric is disassembled and the interlacing degree is determined with respect to the thus separated interlaced yarn. In the present invention, it is indispensable that the thus determined CF value should be within a range of from 70 to 200.

As is apparent from the foregoing illustration, by virtue of the structural feature that the interlaced falsed twisted yarn has a CF value of from 70 to 200 after the dyeing and finishing treatments, and this interlaced yarn is in the fabric in an amount of at least 50% by weight in any one area of the fabric, in the woven fabric of the present invention, the thickness and bulkiness characteristics are highly improved and occurrence of such undesired phenomena as yarn-slip, pilling and snagging is effectively prevented.

The process for producing effectively woven fabrics of the present invention having the above-mentioned excellent properties will now be described. An interlaced multifilament yarn of the present invention is used as the warp for producing the woven fabric according to the present invention. The above-mentioned warp is utilized without providing sizing, even though an interlaced yarn without twist is used. However, to prevent any possible damage of the interlaced effect characterized by $200 \geqq CF \geqq 70$ during the weaving operation, which is mainly due to the repeated load imparted to the warp, it is essential to carry out the weaving operation while the interlaced yarn is positively provided with moisture. The above-mentioned conditions are essential factors to produce the woven fabric according to the present invention.

To maintain the wet condition of the interlaced yarn of warp, it is essential to keep the interlaced yarn in a wet condition at least in the vicinity of the heald(s) and the reed by the supply of water. As mentioned above, the sizing or twisting of the interlaced yarn to utilize it as the warp is unnecessary.

The operational sequence of false twisting and interlacing by the fluid treatment is optional in the process of the present invention. In order to create a desirable interlacing effect, however, it is generally preferred that the false twisting treatment be carried out prior to the fluid treatment. Further, it is a matter of course the conventional false twisting can be performed according to the draw-false twisting method.

The unwinding twists of non-streched yarn, the original twists of a stretched yarn and residual alternating twists often given during the false twisting or fluid treating step have no substantial twisting effect on the yarn. Accordingly, in the present invention, a yarn having such twists is defined as a substantially untwisted yarn. By the term "wet state" is meant the state in which the yarn has a water content of at least 30% inclusive of the standard moisture regain.

During our research we confirmed that all of the warp need not be the interlaced yarn of the present invention. For example, some of the warp may be a textured yarn substantially twisted to impart a sufficient adaptability to weaving. The method for keeping warp in a wet state is not particularly critical. Various methods such as spraying, dripping, continuous and batchwise methods may be adopted. However, it is not preferable to adopt a water applying method in which a tension is excessively given to the yarn.

The kind of water is not critical, and the water need not be pure water. Incorporation of suitable additives into the water will result in enhancement of the CF value reduction-preventing effect intended in the present invention or attainment of other subsidiary effects.

It is believed that a difference in the degree of reduction of the CF value will be brought about according to the average tension given to the warp. As a result of experiments where high loads were imposed five times repeatedly on a polyester-wooly yarn having a CF value of 85, it was found that the interlacing condition is not completely even under a high load of 1.7 g/d, but in the wet state the interlacing condition is retained at a considerably high CF ratio. However, in view of the elastic recovery, it is not preferred to impose a load exceeding 1 g/d, and especially in the case of nylon yarns, application of a load exceeding 1 g/d in the wet state should be avoided. Since it is practically very difficult to perform the weaving operation under an average tension lower than 0.1 g/d, it is preferable that the weaving operation be carried out under an average tension of 0.1 to 1 g/d.

The effects attained by the above-mentioned process of the present invention will now be described.

During the weaving operation, each warp undergo friction among adjoining warp, friction with the heald and the reed, and impulse tension due to the motion of the heald and the reed. Accordingly, some of individual filaments are broken and finally, filament naps are developed.

The interlacing property created by the fluid treatment prevents the concentration of the external force on a few component individual filaments of the warp yarn, and disperses such external force to all of filaments. Further, even when individual filament breaks are caused, propagation thereof is effectively prevented by the above interlacing property and the development of breaks in adjoining filaments is obviated.

It is important to realize that there has not been any attempt to apply the known interlacing technique to a false twisted yarn which is used as the warp for producing a woven fabric without applying the sizing operation to the warp. The main reason for this may be the fact that the weaving technology concerning the utilization of an untwisted multifilament warp without sizing treatment has a very short history. Another reason is that the interlacing treatment cost is unexpectedly high and still another reason is that in the case of such interlaced yarn, it is difficult to obtain a uniform interlacing effect and parts having a completely opened appearance are conspicuous.

The above nap-preventing effect is obtained if the CF value exceeds 60. In order to maintain the interlacing treatment cost at a level as low as possible, it is preferred to reduce the CF value to a level as low as possible. However, from the point of view of adaptability to weaving, it is preferred that the CF value be maintained at a level as high as possible until a fabric is constructed. In order to maintain a CF value of at least 70 in the woven fabric of the present invention, it is preferable that the CF value of the interlaced yarn before the weaving operation be within a range of from 100 to 260. The interlaced condition created by the fluid treatment is drastically lowered by repeated applications of tension, friction under tension and the like, and this reduction is also caused by the weaving operation. Therefore, it is necessary to prevent reduction of the CF value as much as possible during the weaving operation. This problem is conveniently solved by keeping the interlaced warp yarn in the wet state so that the water content is at least 30%, according to the second structural requirement of the present invention. More specifically, if weaving is carried out in such a wet state, the CF value retension rate can be elevated by 10 to 20% as compared with the case where weaving is carried out in the dry state. A method for applying a supplemental oil to the yarn is effective, but this method is not preferable for various reasons. For example, the cost of the supplemental oil increases the manufacturing cost, the scouring or dyeing cost is increased by the presence of such oil and the equipment for prevention of environmental pollution must be arranged and reinforced to treat such oil. In addition to the foregoing effects, another various advantages are attained by application of a small quantity of water according to the present invention. For example, there can be mentioned the resource-saving and energy-saving effects and reduction of a risk of causing environmental pollution. In the present invention, it is indispensable that this wet state should be maintained at least in a region extending from the heald, where an external stress is applied, to a cloth fell. Of course, the wet state may be maintained in other regions. It is preferred that the wet state be uniform throughout the region extending from the heald to the cloth fell, but it is not an indispensable requirement.

The above-mentioned effect of water content in the interlaced warp can not be expected in the case of utilizing the conventional non-bulky interlaced multifilament yarn. That is, when water is applied to the above-mentioned conventional non-bulky interlaced multifilament yarn and a tension is applied thereto, reduction of the degree of interlacing is greater than in the case where water is not applied. When ordinary weaving conditions are adopted and water is applied, even in the case of sufficiently interlaced yarn, the CF value is reduced to such an extent that the yarn only retains a trace of interlace. In contrast, the degree of interlace given to the false twisted yarn according to the present invention is effectively prevented from reduction by application of water. This effect is a very peculiar effect not anticipated by properties of non-bulky interlaced multifilament yarn. Table 1 shows the change of the CF value in non-bulky interlaced multifilament yarn. The measurement of the CF value was conducted in the same manner as described hereinbefore. However, after the shedding and beating operation of the power loom were carried out under omission of the picking operation, since the CF value of the interlaced warp containing water was so low that the measurement of CF value thereof was very difficult, the weight of the constant load used in the measurement was reduced.

Table 1

| Supplemental Oil imparted to the material interlaced yarn | CF value of the material interlaced yarn | CF value of the interlaced warp after water application and weaving operation without picking | CF value of the interlaced warp after weaving operation without picking and water application |
|---|---|---|---|
| A | 43 | 3.1 | 6.8 |
| B | 32.5 | 3.2 | 15.0 |
| C | 27.5 | 4.9 | 10.2 |
| D | 22.0 | 5.0 | 8.2 |

Note:
1) Polyester multifilament yarn of 50d × 18f was used.
2) Initial loads of 10 g were imposed on both sides of the test piece, respectively, and the weight of the constant load was reduced to 0.6 g in the measurement.
3) The test piece was a plain weave fabric, the yarn density in a grey fabric was 102 warps per inch and 94 picks per inch, the tension imparted to each warp was 18 grams, and other conditions were the same as described in Example 3 given hereinafter.

The structural requirement of keeping the yarn in the state of being wet with water can be preferably attained by using a conventional water jet loom without any additional equipment or device being attached thereto. As is well-known, the water jet loom is a high-speed high-efficiency loom.

Accordingly, it is one of advantages of the present invention that the intended woven fabric can be prepared by using the water jet loom. Further, weaving can be carried out by using a non-sized warp and, hence, the sizing operation and the operations of desizing, scouring and drying for the dyeing treatment can be omitted. This is another advantage attained by the present invention.

According to the conventional technique, warps are sized when multifilament yarns are woven by a water jet loom, and the woven fabric should be subjected to the desizing and scouring treatment for removal of such sizing agent. Further, the applied sizing agent is separated from the yarns into the loom during the weaving operation, causing contamination of the woven fabric. According to our experience, it is difficult to prevent contamination with jet soils even by using non-sized yarn. Therefore, it has been impossible to omit the scouring process.

A sizing agent applied to the warp or a treating agent applied to the warp for attaining smoothing and antistatic effects is washed away by water used for insertion of wefts into shedds in the water jet loom. Further, the sizing agent or treating agent is applied again to a reed, a heald, a temple, a temple bar and the like and is kept in the wet state continuously for a long time. As a result, microorganisms glow and propagate in the thus accumulated sizing agent or treating agent to form a massive soil which is generally called "jet soil". These jet soils reduce the weaving efficiency and the quality-grade of a grey fabric. Further, they adhere to grey fabrics and form defects or specks thereon. For overcoming this disadvantage, the loom is generally stopped at a prescribed time interval and soils are removed by water-washing. However, this water-washing treatment brings about various disadvantages. For example, the weaving efficiency is reduced, the quality of warps positioned in the region extended from a back roller to a cloth fell is soiled at the washing step, and removed masses of soils often adhere to grey fabrics. Still further, scouring should be performed sufficiently to remove such soils adhereing to grey fabrics. In order to prevent occurrence of the foregoing troubles, it is necessary to prevent generation of such jet soils at least for a period required for weaving one weaver's beam.

In accordance with one preferred embodiment of the present invention, there is provided a weaving process in which the above problem is effectively solved. According to the preferred embodiment of the present invention, the following multifilament yarn is preferably used for making the false twisted and interlaced yarn which is utilized for producing the woven fabric of the invention by means of the water jet loom, that is, the isolation ratio of the treating agent by the heat treatment of at least 160° C.×0.1 second is reduced, and the amount of the treating agent isolated after the heat treatment is smaller than 0.6% owf and the residual amount of the treating agent left after the heat treatment is smaller than 1.0% owf. The above-mentioned multifilament yarn is subjected to the conventional false twisting process, and the resulted yarn is successively subjected to the interlacing treatment. The multifilament yarn, which is utilized as the weft, can be omitted in the interlacing treatment.

Thus obtained interlaced yarn is utilized as the warp for producing the woven fabric of the invention, in such a condition that the sizing of the warp is omitted. In order to attain the intended objects of the present invention sufficiently, it is desired that the foregoing interlaced multifilament yarn to be used as the warp be sufficiently interlaced.

By the term "the residual amount of the treating agent" used herein is meant the amount of the stuck treating agent measured by drying in vacuo a sample test piece at 20° C for 24 hours; immersing the test piece in water maintained at 20° C for 5 minutes, the amount of water being 30 times the weight of the test piece; subjecting the test piece to centrifugal dehydration for 20 minutes; drying the test piece in vacuo at 20° C for 24 hours, and; then, measuring the amount of the treating agent stuck to the test piece according to the methanol extraction method described below. The amount of the treating agent isolated is expressed by the difference between the amount of the treating agent stuck to the test piece before the water treatment and the amount of the treating agent left on the test piece after the water treatment. The isolation ratio is a ratio of the above-mentioned amount of the treating agent isolated to the amount of the treating agent stuck to the test piece before the water treatment. The thus determined residual amount of the treating agent is found to coincide to the amount of the treating agent actually left on the resulting grey fabric.

The amount of the treating agent stuck on the filament is determined according to the following method. A test piece is dried in vacuo at 20° C for 24 hours, and it is then kept in an atmosphere maintained at a temperature of 20° C and a relative humidity of 65% for 24 hours. A flask having a weight of about 100 g is immersed in an aqueous solution of chromic acid for 24 hours, washed with water sufficiently, immersed in a 1% aqueous solution of sodium hydroxide for 5 minutes and washed sufficiently with water. Then, the flask is dried at 105° C for 1.5 hours and is stored and cooled in a desiccator. After it has been cooled for 1.5 hours, the flask is taken out of the desiccator and the weight $W_1$ of the flask is weighed by a direct reading balance. Then, the flask is stored again in the desiccator. A above test piece in an amount of 10±0.02g is taken and weighed to determine the weight $W_0$. Then, the flask is taken out of the desiccator by using clean tweezers washed sufficiently with an organic solvent and the weighed test piece is put in the flask. Then, 100 ml of methanol is charged into the test piececharged flask by using a washed clean pipette. A Soxhlet extractor is attached to the flask. The assembly is set on a steam bath and after refluxing has been continued for 3 hours, the supply of steam is stopped and the test piece is taken out by tweezers. Then, the extractor is attached again and methanol is recovered completely. As soon as the flask is separated the outside is wiped with a clean cloth. Then, the flask is put in a drier maintained at 105°±5° C and after 0.5 hour has passed, the flask is taken out and stored in the above-mentioned desiccator. The flask is cooled for 1.5 hours, and the weight $W_2$ of the flask is measured by a direct reading balance. The amount of the treating agent stuck to the yarn is calculated according to the following equation:

$$\text{Amount Stuck (\%)} = \frac{W_2 - W_1}{W_0} \times 100$$

Each of the instruments used for the measurement is employed after it has been sufficiently washed and dried. The flask is handled with dry cloth gloves.

The foregoing preferred embodiment of the present invention will now be described in detail.

It is indispensable that in the multifilament yarn of the present invention the residual amount of the treating agent should be smaller than 1.0% owf. When the residual amount is larger than 1.0% owf, if the scouring step is omitted, such defects as uneven dyeing, batch-to-batch variation and reduction of the color fastness are caused.

It is also indispensable that the amount of the treating agent isolated should be smaller than 0.6% owf. If the amount of the treating agent isolated is larger than 0.6% owf, jet soils are formed.

In the yarn manufacturing process, a treating agent is applied at the spinning process and subsequent processes so as to pass yarns in good conditions through these processes. The so applied treating agent is washed away and isolated with water at the weaving process using a water jet loom, resulting in formation of jet soils.

In the present invention, a treating agent, the isolation ratio of which is reduced by the heat treatment, is used in order to reduce isolation of the treating agent. If the isolation ratio after the heat treatment is too low, when dyeing is carried out while omitting the scouring step, the treating agent is difficult to remove by water and such troubles occur as the incorporation and accumulation of the treating agent left on the grey fabric into the dyeing solution. Especially in the case of continuous dyeing, such accumulation of the treating agent in the dyeing solution is conspicuous and causes secondary troubles in many cases. Accordingly, too low an isolation ratio after the heat treatment is not preferred. In contrast, if this isolation ratio is too high, in order to maintain the amount isolated at a level lower than 0.6% owf and prevent formation of jet soils, it is necessary to reduce the amount of the treating agent to be applied to the fiber. However, if the amount applied is reduced, it becomes difficult to pass yarns smoothly in good conditions through the manufacturing steps preceding to the weaving step. In view of the foregoing, it is preferred that the isolation ratio after the heat treatment be 15 to 85%, especially 25 to 80%.

In this preferred embodiment, by subjecting multifilament yarns to the heat treatment, there can be attained various advantages. For example, since the scouring step can be omitted, scattering of the treating agent applied during and after the spinning step can be reduced and hence, the amount of the treating agent which it is necessary to apply can be reduced. Further, the emulsion balance of the treating agent is destroyed by the heat treatment to reduce the isolation ratio and the treating agent is hardly isolated by water at the weaving step, whereby formation of jet soils is effectively controlled. The ordinary heat treatment to be conducted after the drawing process is insufficient as the heat treatment for attaining the above purpose. Accordingly, the heat treatment referred to herein means a heat treatment more violent than the above ordinary heat treatment to be conducted after the drawing process. More specifically, a heat treatment of at least 160° C × 0.1 second is meant. Effects of scattering the treating agent and reducing the isolation ratio are conspicuous when multifilament yarns are subjected to a heat treatment of at least 160° C × 0.15 second and, hence, a heat treatment of at least 160° C × 0.15 second is preferable. When scattering of the treating agent is too much at the heat treatment step, contamination with the scattered treating agent is caused and an economical disadvantage is brought about by wasteful consumption of the treating agent. Therefore, it is preferred that the ratio of scattering of the treating agent at the heat treatment step be lower than 90%.

When the above-mentioned multifilament yarn are used as the warp in a condition without sizing for producing the woven fabric of the present invention by means of a water jet loom, such warp should be interlaced so as to satisfy the purpose of the present invention. In the case of crimped yarn, in order to attain the interlaced property required for weaving, it is preferred that the CF value be higher than 60, especially at least 90. In order to satisfy the fundamental requirement of the present invention that the CF value of the warp in the woven fabric should be within a range of from 70 to 200, it is preferred that the CF value of the warp before weaving be within a range of from 100 to 260. Also in this case, the CF value is measured according to the method described hereinbefore. Criticalities of these CF values are as described hereinbefore.

When interlaced crimped yarn is subjected to a weaving process without sizing, it is necessary to use the yarn having a higher uniformity of interlace and a higher interlacing durability. When the conventional method heretofore used for measurement of CF values of yarn without crimps is used for measurement of CF values of crimped yarn, the slip of a needle pierced among individual filaments is lowered because of entanglements of individual filaments caused by crimping and, therefore, there is a risk that the compactness of the yarn is overrated.

Effects attained by the foregoing preferred embodiment using specific heat-treated multifilament yarn is as follows.

(1) By the heat treatment of at least 160° C × 0.1 second, the treating agent is scattered and the amount of the stuck treating agent can be reduced. This effect is especially conspicuous when the yarn is heat-treated while being turned about the lengthwise axis of the yarn as in the case of false twisting.

(2) The emulsion balance of the treating agent is destroyed by the above heat treatment and the isolation ratio of the treating agent can be reduced. Therefore, the amount of the treating agent isolated in water during the weaving operation can be reduced. Further, since the amount isolated of the treating agent is smaller than 0.6% owf, formation of jet soils can be prevented.

(3) In the interlaced multifilament yarn of this preferred embodiment, the residual amount of the treating agent is reduced to a level lower than 1.0% owf. Accordingly, even if dyeing is performed while omitting the scouring step, such troubles as uneven dyeing, batch-to-batch variation and reduction of the color fastness are not caused.

(4) In case interlaced yarn for use as the warp is prepared, if the amount of the treating agent is lowered and then the yarn is subjected to the interlace treatment, there is attained a merit that the interlacing effect is enhanced. Especially when the amount of the treating agent is reduced below 0.6% owf, slip among the component individual filaments is reduced and good entanglement is obtained at the interlacing treatment. The adhesive force among individual filaments is reduced when the amount of the treating agent is smaller than 0.6% owf and the opening effect among individual filaments is increased to enhance the effect of interlacing. This effect is especially conspicuous when the amount of the treating agent is smaller than 0.5% owf.

As is seen from the foregoing illustration, according to this preferred embodiment of the present invention, formation of jet soils is effectively prevented during weaving without sizing using a water jet loom, and such processes as desizing, scouring and drying process can be omitted in the dyeing process. Thus, woven fabric of multifilament yarn can be provided in a very rational manner.

The treating agent to be used in the present invention is applied mainly for passing yarn smoothly through such processes as spinning, drawing and crimping processes. Accordingly, it is generally required that the treating agent should possess both the smoothing and antistatic activites. In general, a treating agent comprising a smoothing component and an antistatic component is used. In combining the two components, the mutual actions between the two components and their actions on the dye should be considered, because the dyeing is carried out while omitting the scouring step.

As the smoothing component, there are used, for example, mineral oils, fatty acid esters and polyhydric alcohols, and; as the antistatic component, there are employed, for example, higher fatty acid salts, sulfonic acid salts, phosphoric acid salts and triethanol amine salts. In order for the antistatic component not to have bad influences on the dyeability, it is generally preferred that the amount of the antistatic agent be controlled below 20%.

The time of application of the treating agent is not particularly critical, and the treating agent may be applied during the spinning operation, prior to the heat treatment or during the heat treatment.

After the treating agent has been applied and the heat treatment has been conducted, the treating agent may be applied again for some special purpose. In this case, however, the kind and amount of the oil to be applied must be selected very carefully so that attainment of the objects of the present invention is not hindered at all. For example, in the case of a cationic corn oil, it is necessary to reduce the residual amount to a level as low as possible.

In accordance with another preferred embodiment of the present invention, there is provided a weaving process without sizing the warp, by means of a water jet loom. In this case a particular multifilament yarn is utilized for producing the false twisted and interlaced yarn which is utilized for the warp of the woven fabric of the invention. Such particular multifilament yarn is provided with a treating agent having such property that the isolation ratio is increased by the heat treatment and the isolation ratio thereof after the heat treatment is lower than 0.6% owf and the residual amount of the treating agent after the heat treatment is smaller than 1.0% owf. The intended objects of the present invention are effectively attained when the multifilament yarn to be used as the warp are those that have been sufficiently subjected to the interlacing treatment.

In this preferred embodiment, in order to isolate the treating agent by water at the weaving process, a treating agent having such a property that the isolation ratio is increased by the heat treatment is employed. It is preferred that by the heat treatment the isolation ratio be increased to at least 1.1 times the isolation ratio before the heat treatment. It is also preferred that the isolation ratio before the heat treatment be at least 50%, especially at least 75%.

In the yarn manufacturing process, a treating agent is generally applied to the yarn at the spinning process and subsequent processes so as to pass the yarn in good conditions through these processes. In general, scattering of the treating agent is caused by the heat treatment conducted in the yarn manufacturing process. If a treating agent that tends to scatter is used, in order to leave, the treating agent in an amount enough to pass the yarn in good conditions through the processes after the heat treatment, it is necessary to increase the amount of the treating agent stuck to the yarn before the heat treatment. However, if the treating agent is applied in such a large amount, yarn passage is readily contaminated with the treating agent, and use of a large amount of the treating agent is not preferred from the economical viewpoint. Accordingly, treating agents having a relatively reduced tendency to scatter have heretofore been used in the art. In these treating agents customarily used, emulsion balance is generally destroyed by the heat treatment and the treating agents are difficult to isolated at the weaving step by water. Accordingly, the residual amount is large and it is difficult to omit the scouring step. If the amount of the treating agent applied is decreased to reduce the residual amount, it becomes difficult to pass the yarn in good conditions through processes, especially the processes where great friction is imposed on the yarn after the heat treatment, such as the false twisting process, and such troubles as yarn break readily occur. Accordingly, if treating agents having such a property that scattering on the heat treatment is greatly reduced are employed, omission of the scouring step, which will result in great economical advantages, is impossible according to the conventional techniques. Therefore, such treating agents have not been used for the weaving process without sizing capable of omitting the scouring process.

In contrast, according to this preferred embodiment of the present invention, a treating agent which is rendered ready to be isolated by water by the heat treatment is employed, and the isolation ratio of the treating agent after the heat treatment is as low as below 0.6% owf. Accordingly, no jet soils are formed and the residual amount of the treating agent is reduced below 1.0% owf. Therefore, the scouring step can be omitted conveniently. When a treating agent in which the ratio of scattering on the heat treatment is lower than 40% is employed, in the case of conventional treating agents in which the isolation ratio is reduced by the heat treatment, there is fear that residual amounts are increased. However, according to the present invention, especially conspicuous effects can be obtained when a treating agent having a low scattering ratio is employed. A heat treatment ordinarily conducted at the drawing process is insufficient as the heat treatment for increasing the isolation ratio of the treating agent, and a heat treatment more violent than the heat treatment customarily adopted at the drawing process is conducted for attaining this purpose. More specifically, an increase of the isolation ratio is prominent when a heat treatment of at least 160° C × 0.1 second is conducted and adoption of such heat treatment is preferred. Especially good results are obtained by a heat treatment of at least 160° C × 0.15 second.

In order to carry out the weaving operation without sizing process, by means of the water jet loom, while using such multifilament yarn as warp, the multifilament yarn should be subjected to the interlacing treatment so that the compactness of the multifilament yarn, which is necessary for weaving, is imparted to the yarn. As pointed out hereinbefore, in the case of utilizing crimped yarn, it is preferred that the multifilament yarn be collected by the interlacing treatment to such an extent that the CF value before the weaving operation is within a range of from 100 to 260.

Effects attained by this preferred embodiment of the present invention are as follows.

(1) Since the isolation ratio of the treating agent is increased by the heat treatment, it is possible to omit the scouring step for isolating the treating agent with water after the weaving process. This effect is especially conspicuous when the heat treatment is conducted while the yarns are turning along the axis thereof, as in the false twisting process.

(2) Since the amount isolated of the treating agent is smaller than 0.6% owf, no jet soils are formed.

(3) Since the residual amount of the treating agent is smaller than 1.0% owf, even if the scouring step is omitted, such troubles as uneven dyeing, batch-to-batch variation and reduction of the color fastness are not brought about.

Therefore, if the weaving operation utilizing the warp yarn without sizing treatment is carried out by means of the water jet loom according to the present invention, formation of jet soils is prevented and such processes as desizing, scouring and drying treatments are omitted in the dyeing process. Accordingly, multifilament woven fabric can be produced very rationally in this preferred embodiment of the present invention.

In this preferred embodiment, the treating agent is used mainly for passing the yarn smoothly in good conditions through the conventional spinning, stretching and crimping processes. Accordingly, it is required that the treating agent should possess both the smoothing and antistatic activities and, in general, a treating agent comprising a smoothing component and an antistatic component is employed. In combining the two components, the mutual actions between the two components and their actions on the dye should be considered, because th dyeing is carried out while omitting the scouring step. As the smoothing component, there are employed, for example, polyoxyalkylene adducts, such as polyoxyalkylene fatty acid esters, polyoxyalkylene dibasic acid diesters, polyoxyalkylene higher alcohol ethers, polyoxyalkylene polyhydric alcohol ethers and polyoxyalkylene copolymers.

As the antistatic component, there are used, for example, higher fatty acid salts, sulfonic acid salts, phosphoric acid salts and triethanol amine salts. In order for the antistatic component not to have bad influences on the dyeability, it is generally preferred that the amount of the antistatic component be controlled below 20%.

The time of application of the treating agent is not particularly critical, and the treating agent may be applied during the spinning operation, prior to the heat treatment or during the heat treatment.

After the treating agent has been applied and the heat treatment has been conducted, the treating agent may be applied again for some special purpose. In this case, however, it is necessary to select the kind and amount of the treating oil to be applied very carefully so that attainment of the objects of the present invention is not hindered at all. For example, in the case of a cationic corn oil, it is necessary to reduce the residual amount to a level as low as possible.

The heat treatment referred to herein may be applied to any of the drawing process, the false twisting process, the draw-false twisting process, the stuffing process, the embossing process, the fluid processing and the process for developing latent crimps of an assymmetric structure or the like, or the heat treatment may be applied to two or more of these processes in combination. In short, the heat treatment may be applied to any process in which attainment of the intended effects is expected. The heat treatment may be performed in one stage or in multiple stages.

It is preferred that the interlacing treatment using a fluid be adopted for imparting the required compactness to multifilament yarn to be used as the warp in practising this preferred embodiment of the present invention. This interlacing treatment may be conducted prior to, during or after the above-mentioned heat treatment.

In accordance with still another preferred embodiment of the present invention, there are provided multifilament crimped yarns suitable for the weaving utilizing the warp yarn without sizing treatment, by means of the water jet loom.

In this preferred embodiment, a treating agent comprising at least 50% of a water-soluble compound composed of an ethylene oxide-propylene oxide random adduct and/or an ethylene oxide-propylene oxide random copolymer, in which the molecular weight is at least 2500 and the proportion of the molecular weight occupied by ethylene oxide units is 25 to 85% by weight of the total molecular weight, is applied to the multifilament yarn to be used for producing the intended woven fabric of the present invention. The amount isolated of this treating agent is smaller than 0.6% owf and the residual amount of the treating agent is 1.0% owf. When multifilament crimped yarn to which the above treating agent has been applied and which has been subjected to the abovementioned interlacing treatment is used, the weaving utilizing the warp yarn without sizing by means of water jet loom can be performed very conveniently. In this embodiment, it is preferred that the treating agent used be liquid at room temperature.

In order to pass the yarn smoothly in good conditions through processes up to the crimping process, a treating agent is generally applied to the yarn at the spinning process and subsequent processes. Since the treating agent is often used in combination with water, it is preferred that the treating agent be water-soluble.

In combining the smoothing component and antistatic component, the same cares as mentioned with respect to the foregoing preferred embodiment should be taken, and the treating agent is applied in the same manner as described above with respect to the foregoing preferred embodiment.

Since the treating agent comprising a main component having a molecular weight of at least 2500 has been applied to crimpled multifilament yarn to be used in this preferred embodiment, the scattering of the treating agent during the heat treatment is very reduced while the processing adaptability to each step is maintained at a high level. Further, since the treating agent is water-soluble, it can readily be isolated during the weaving step. Moreover, since the water-solubility of the treating agent is enhanced by the heat treatment, the treating agent can easily be isolated with water. Still further, the residual amount of the treating agent is smaller than 1.0% owf. Therefore, the scouring step can be omitted conveniently. In addition, since the amount isolated is smaller than 0.6% owf in the treating agent, no jet soils are formed.

The reason the water-solubility of the treating agent is enhanced by the heat treatment is believed to be as follows. The molecule chain of the ethylene oxide-propylene oxide adduct or copolymer undergoes thermal decomposition at the heat treatment step, whereby the molecular weight is reduced and the water-solubility is enhanced. This change is more conspicuous when ethylene oxide and propylene oxide units are randomly arranged than when ethylene oxide and propylene oxide are in a block arrangement. Further, ethylene oxide is more water-soluble than propylene oxide. As pointed out hereinabove, in the treating agent to be used in this preferred embodiment of the present invention, the proportion of the ethylene oxide units is 25 to 85% and the thylene oxide units and propylene oxide units are randomly arranged. Accordingly, an increase of the water solubility by the heat treatment is conspicuous, and the heat-treated agent can readily be isolated with water at the weaving step.

Effects attained by this preferred embodiments are follows.

(1) In the treating agent used in this preferred embodiment, scattering during the heat treatment is very reduced and hence, such scattering does not contaminate the yarn passage of the heat treatment device. Further, since a substantial amount of the treating agent is left even after the heat treatment, good results are obtained even when it is applied to yarns of which a high abrasion resistance is required, for example, crimped yarn. Especially good results are obtained when the treating agent is applied to the yarn which are to be subjected to the frictional false twisting treatment or weaving utilizing the warp without sizing.

(2) Although the amount of the treating agent stuck to the yarn after the heat treatment is not reduced, since the isoltation ratio of the treating agent is increased by the heat treatment, the treating agent can readily be isolated with water during the weaving process and the scouring process can be omitted conveniently.

(3) Since the amount isolated of the treating agent is smaller than 0.6% owf, even if the treating agent is isolated with water during the weaving operation, no jet soils are formed.

The present invention will now be illustrated in detail by reference to the following Examples that by no means limit the scope of the invention.

EXAMPLE 1

Five kinds of wooly type polyester false twisted multifilament yarns of $150d \times 48f$, as indicated in Table 2, were used as the warp yarn. Similar false twisted yarn which had not been twisted at all were used as the weft yarns. Plain weave fabrics were produced by using these warps and wefts in such a condition that the yarn density after the dyeing treatment was 77 warps per inch and 69 wefts per inch.

Table 2

| Test Piece No. | Kind of yarn | CF Value of the interlaced warp of the Dyed Woven Fabric | Weight ratio (%) of the interlaced yarn in the Woven Fabric |
|---|---|---|---|
| L-1 | Untwisted multifilament yarn | 11.2 | 0 |
| L-2 | Multifilament yarn having additional twists (80 T/m) | 15.0 | 0 |
| L-3 | Interlaced yarn of the invention | 75 | 53 |
| L-4 | " | 170 | 53 |
| L-5 | " | 210 | 53 |

Figure 2:
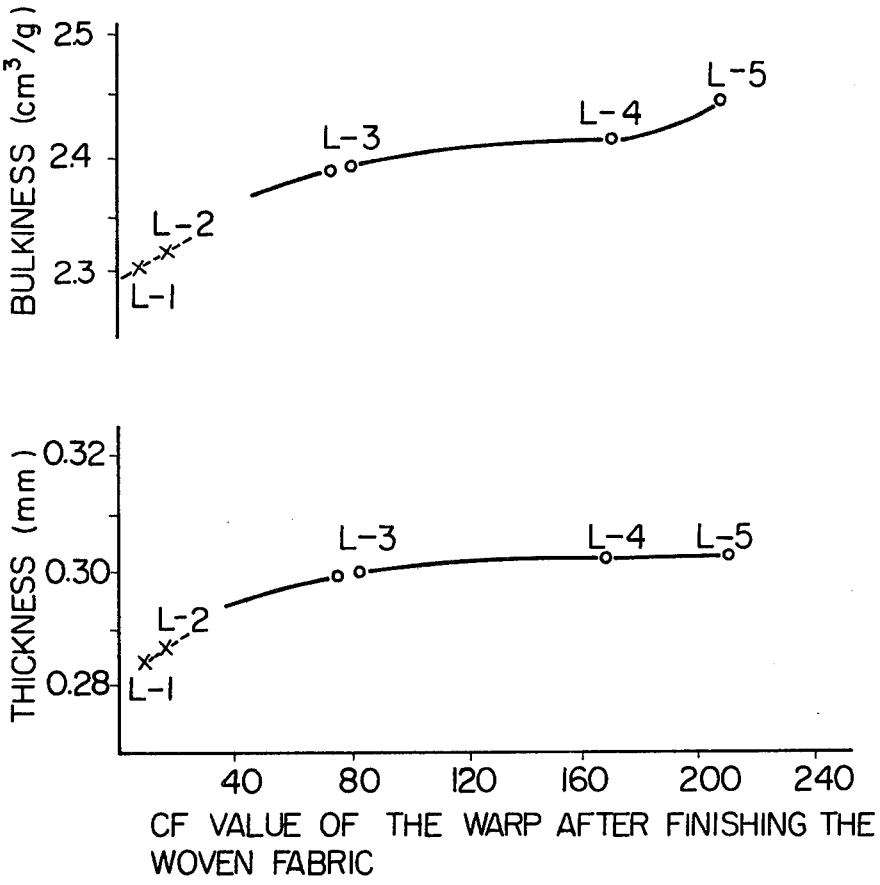
FIG. 2 is a diagramatical representation indicating the relations between the CF value of the warp and the bulkiness (in $cm^3/g$) thickness (in mm) of the finished woven fabric disclosed in Example 1.

The thickness and bulkiness were measured with respect to the so obtained five woven fabrics, and the relation between these measured values and the CF value of the warp are shown in FIG. 2. The thickness of the woven fabric was measured under a dead weight of 50 g/cm$^2$.

The bulkiness was calculated from the unit weight (g/cm$^2$) separately determined and the thickness determined by the above method, according to the following equation:

$$\text{Bulkiness (cm}^3\text{/g)} = \frac{\text{thickness (cm)}}{\text{unit weight (g/cm}^2\text{)}}$$

From the results shown in FIG. 2, it is seen that woven fabrics prepared by using the interlaced yarns L-3 to L-5 according to the present invention had greater thickness and higher bulkiness than woven fabrics produced by using untwisted yarn L-1 and the multifilament yarn having additional twists L-2. It is seen from the results shown in Table 2 that in woven fabrics prepared by using the interlaced multifilament yarns according to the present invention the CF value exceeded 70 and was much higher than in the woven fabrics prepared by using the originally twisted yarn or the multifilament yarn provided with the additional twists.

EXAMPLE 2

False twisted wooly type polyester multifilament yarn of 150*d* × 48*f*, which had been subjected to the interlacing treatment so that the CF value in the resulting fabric after the dyeing process was 210, was used as the warp and 7 kinds of yarns, as indicated in Table 3, were used as the weft. Seven kinds of plain weave fabrics were prepared by using these warp and weft. In each fabric, the density after the dyeing process was 74 warps per inch and 71 wefts per inch. The resistance to the yarn slip by the pulling-out of wefts and snagging in the lateral direction were determined with respect to each fabric to obtain the results shown in FIG. 3.

The resistance to yarn slip is a value which closely correlates to the resistance against the pulling out of the weft from the fabric, and it is expressed in terms of a maximum resistance observed when two yarns are pulled out of a fabric of test piece having a length of 3 cm, at a speed of 10 cm/min. In this Example, wefts were pulled out for measurement.

Snagging is a value determined according to a certain method for measuring the hitching resistance of individual filaments from the surface of the fabric, which is a serious problem in the woven fabric utilizing the textured yarn. More specifically, a fabric test piece having a length of 16 cm and a width of 10 cm was folded double in a loop-like form in the longitudinal direction. Then, the fabric test piece was placed in contact with the surface of a card clothing roll and the roller was turned 5 times to scratch the surface of the fabric. The quantity of snags thus formed was evaluated based on the following scale.

Grade 1: quantity of snags is conspicuously large
Grade 2: quantity of snags is large
Grade 3: considerable snags are observed Incidentally, lower grade 2 means that formation of snags is intermediate between grade 1 and grade 2, and upper grade 2 means that formation of snags is intermediate between grade 2 and grade 3.

Table 3

| Test piece No. | Kind of yarn | CF value of the interlaced warp of the Dyed Woven Fabric | Weight ratio (%) of the interlaced yarn in the Woven Fabric |
|---|---|---|---|
| L-7 | Untwisted multifilament yarn | 8 | 53 |
| L-8 | Multifilament yarn having additional twists (80 T/m) | 16 | 53 |
| L-9 | Multifilament yarn having additional twists (200 T/m) | 30 | 53 |
| L-10 | Interlaced yarn of the invention | 126 | 100 |
| L-11 | " | 160 | 100 |
| L-12 | " | 190 | 100 |
| L-13 | " | 210 | 100 |

Figure 3:
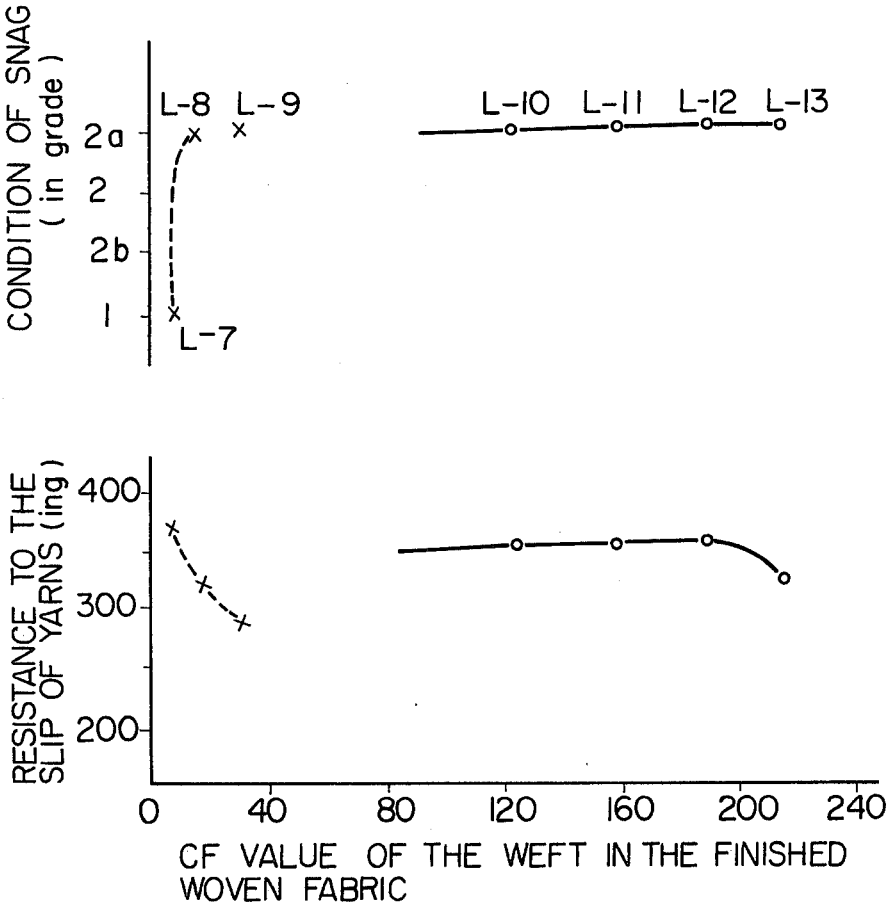
FIG. 3 is a diagramatical representation indicating the relations between the CF value of the weft and the condition of snag (in grade), resistance to the slip of yarns (in g), of the finished woven fabric disclosed in Example 2.

As can be seen from the results shown in FIG. 3, the resistance to yarn slip in the woven fabric was reduced when the yarn L-8 and the yarn L-9 were employed and it was observed that the yarn slip in the woven fabric was likely to occur. When the interlaced yarns L-10 to L-12 were used according to the present invention, the resistance to yarn slip in the woven fabric was maintained at a substantially constant high level as far as the CF value was within a range of about 100 to about 200. In these fabrics occurrence of yarn slip was much reduced over woven fabrics prepared by using the multifilament yarn provided with additional twists. As is seen in the test piece prepared by using yarn L-13, when the CF value exceeded about 200, reduction of the resistance to yarn slip was observed.

In the test piece prepared by using the yarn provided with the original twist, the degree of snagging was grade 1 and formation of snags were conspicuous. In contrast, in eact of test pieces prepared by using yarns L-8 and L-9 and the interlaced yarns L-10 to L-12, the degree of snagging was higher than grade 2 as long as the CF value was higher than 70. Accordingly, it will readily be understood that when the interlaced yarns of a CF value higher than 70 are used according to the present invention, formation of snags is reduced to a level substantially equal to that of woven fabrics prepared by using the multifilament yarn provided with additional twists, and possibility of causing yarn slip is very much lowered over woven fabrics prepared by using the multifilament yarn provided with additional twists.

When the foregoing test pieces were subjected to a pilling test using an ICI tester according to the method of the Japanese Industrial Standard, JIS L-1076, it was found that in each of fabrics prepared by using yarns L-7 to L-12, the degree of pilling was grade 5 and pilling was not serious in these samples, although the actual data obtained are not specifically illustrated in the drawings.

Figure 4:
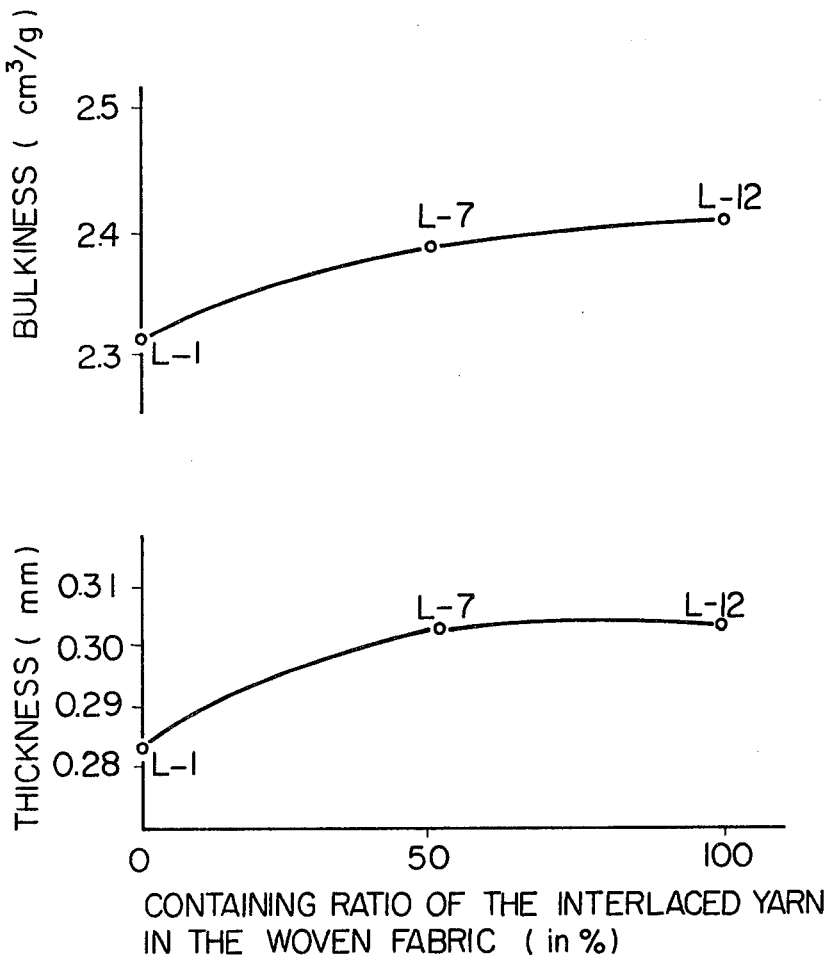
FIG. 4 is a diagramatical representation indicating the relation between the bulkiness (in $cm^3/g$), thickness (in mm) and the containing ratio of the interlaced yarn in the woven fabric (in %) disclosed in Example 2.

The thickness and bulkiness of each of the fabrics L-1, of Example 1, prepared by using untwisted false twisted yarns as the warps and wefts and the fabrics L-7 and L-12, of Example 2, having the interlaced yarn contents of 53% and 100%, respectively, are shown in FIG. 4. From the results shown in FIG. 4, it will readily be understood that great differences of both the thickness and bulkiness are observed between fabrics of the interlaced yarn content of 0% and fabrics of the interlaced yarn content of at least 50%, and; that if the interlaced yarn content is increased to a level of at least 50%, according to the present invention, both the thickness and bulkiness characteristics are highly improved.

As is apparent from the foregoing illustration, in the textured yarn woven fabric of the present invention, by virtue of the structural feature that the compactness is imparted to a false twisted yarn by the interlacing treatment to such an extent that the CF value of the woven fabric after the dyeing treatment is at least 70 and the content of the interlaced yarn in the fabric is at least 50%, the thickness and bulkiness characteristics are highly improved, and the resistance to yarn slip and anti-snagging and anti-pilling properties are maintained at sufficiently high levels.

EXAMPLE 3

False twisted wooly polyester multifilament yarns of $150d \times 48f$ (a yarn A) were subjected to the interlacing treatment using air jets to obtain the yarn B having a CF value of 37.2, a yarn C having a CF value of 47.0, a yarn D having a CF value of 56.5, a yarn E having a CF value of 79.8, a yarn F having a CF value of 85.8 and a yarn G having a CF value of 130, respectively. Plain weave fabrics were prepared by using the yarn A as the wefts and using the yarns A to G as the warp yarn, respectively. The yarn density of a grey woven fabric was 69 warps per inch and 60 picks per inch. Under a warp tension of 45 g per thread the water jet loom was driven at a rotation speed 300 r.p.m. To measure the CF value of the interlaced warp yarn, picking of the wefts into the sheds was omitted for a very time corresponding to a predetermined length of the warp. The test pieces were taken from the above-mentioned weft free portion and the CF value of the interlaced yarn was measured. Next, a spray nozzle was mounted on the loom at a position adjacently downstream of the passage of the reed, and the water was sprayed toward the warps. In such condition, the weaving operation without picking the weft was carried out in the same manner as mentioned above. It was confirmed that the interlaced yarn of warp was sufficiently wet with water but the sprayed water was substantially interrupted by the heald. However, the warps upstream of the heald were wet and the warps downstream of the reed were so wet that water dripped from the yarn. The CF value of the interlaced yarn of warp was measured in the same manner as described above.

A supplemental oil composed mainly of a mineral oil was applied in an amount of 3% to each of the foregoing yarns B to G, and in the same manner as described above, the yarns were wetted with water, the weaving operation without picking was conducted and the CF value was measured.

Figure 5:
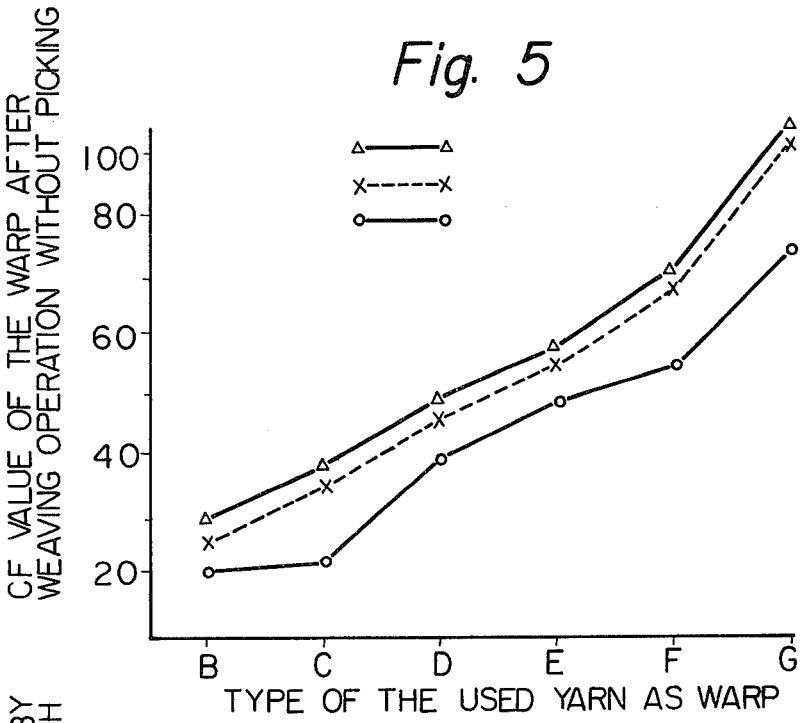
FIG. 5 is a diagramatical representation indicating the relation between the CF value of the warp after the weaving operation without picking and the type of the used yarn as warp, based on Example 3.

Results obtained are plotted in FIG. 5, from which it will readily be understood that the CF value retention ratio is high when the warps are keep in a wet condition during the weaving operation. It is suggested that considerable effects will be obtained if a suitable supplemental oil is chosen and used. In case the picking of the wefts is also carried out in the above-mentioned weaving operation, when a weft inserted in a shed is beaten by the reed toward the cloth fell, the warp tension is impulsively increased. According to such beating action, the CF value of the interlaced warp yarn is reduced from the original value of FIG. 5 by about 10% or more. Accordingly, in order to maintain the CF value of the warp in the woven fabric at a level of 70 to 200, it is necessary to adjust the CF value before the weaving operation to 100 to 260.

EXAMPLE 4

Figure 6:
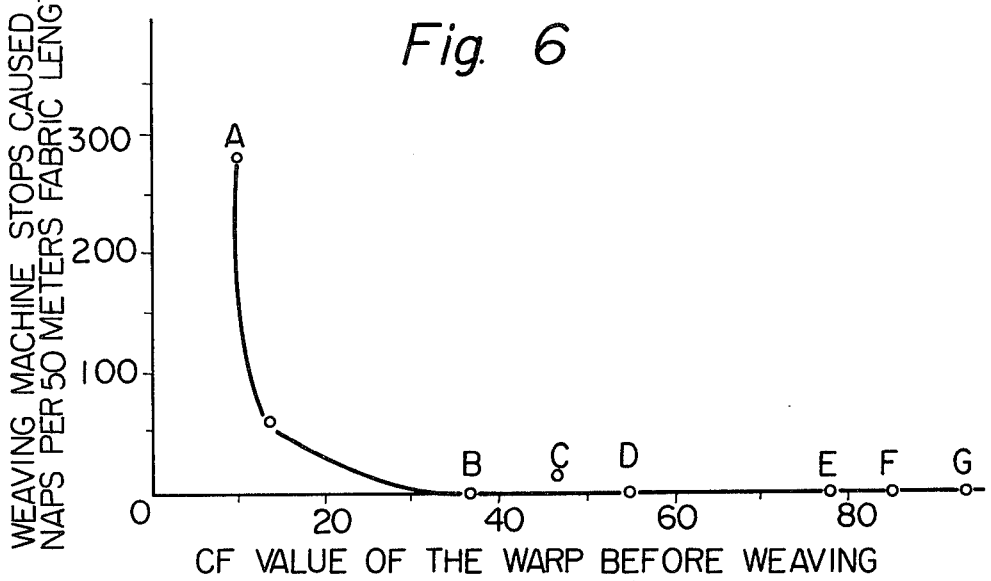
FIG. 6 is a diagramatical representation indicating the relation between number of weaving machine stops caused by naps per 50 meters fabric length and the CF value of the warp before weaving, based on Example 3.

By using yarns A to G described in Example 3 as warps and the yarn A as wefts, woven fabrics having the same yarn density as in Example 3 were woven while keeping the yarns sufficiently wet with water at a loom rotation speed of 300 r.p.m. With respect to each of the so obtained woven fabrics, the frequency of formation of naps on the warps was examined to obtained results shown in FIG. 6. In woven fabrics of this type, the standard efficiency control level concerning frequency of formation of naps is set as 1 nap per 50 m or lower. From the results shown in FIG. 6, it is seen that this control level can be obtained if the CF value is higher than 60.

EXAMPLE 5

In order to clarify the relation between the water content and the CF value reduction preventing effect, the following experiment was carried out.

Figure 7:
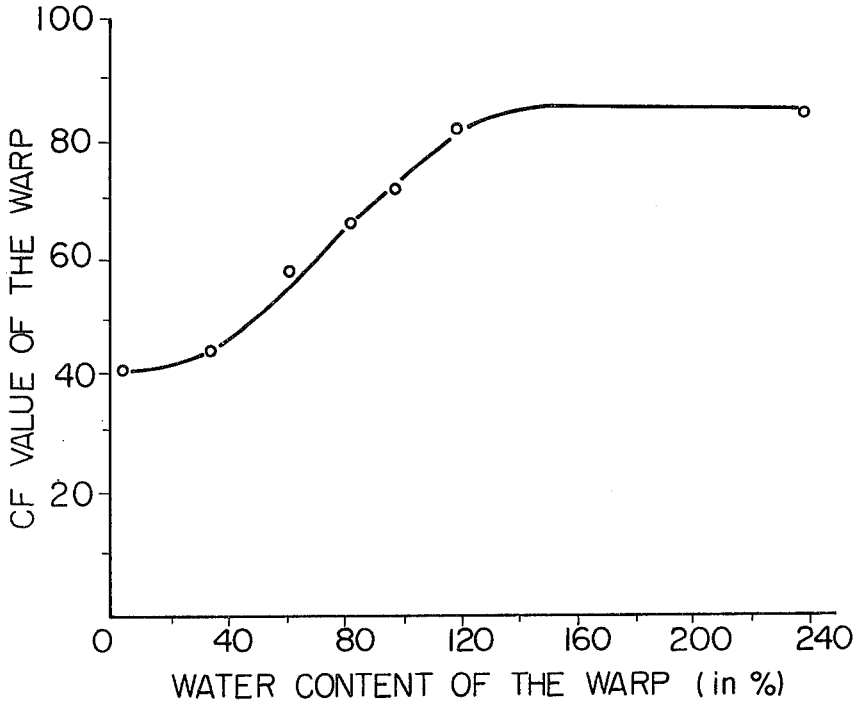
FIG. 7 is a diagramatical representation indicating the relation between the CF value of the warp after drying treatment and the water content of the warp on the loom, based on Example 5.
Figure 10:
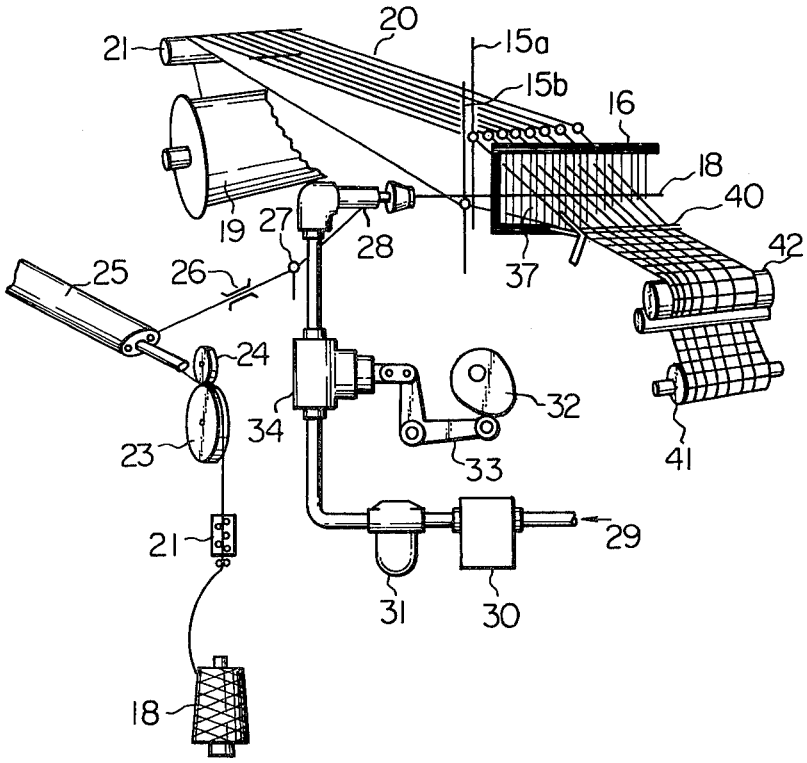
FIG. 10 is a perspective view, in section, of the weaving apparatus.

Water was supplied to polyester wooly yarns of $150d \times 14f$ having a CF value of 170 to obtain several kinds of samples differing in water content. A specimen of a length of 70 cm was taken out of the test piece and a load of 50 g was applied to the lower end of the specimen and the specimen was wound by one turn on a stain-embossed plated metal rod having a diameter of 5 mm. Then, the upper end of the specimen was held tightly, and the specimen was pulled upwardly at a speed of 4 m/min and it was pulled down at the same speed by the weight of the load. This upward and downward movement was repeated 3 times and, then, the load was taken out and the specimen was allowed to stand still overnight and thus dried. This test was conducted on five specimens with respect to each test piece. After the specimen had been sufficiently dried, the CF value was measured. Results obtained are plotted on FIG. 7, from which it will readily be understood that when the water content is 30% or higher, reduction of the CF value is effectively controlled.

A relatively higher standard CF value of 170 was set in the above experiment in view of safety in actual production, although the lower limit of the CF value specified in the present invention is 70. Of course, even at this critical CF value the intended objects of the present invention can be attained. The load of 50 g was adopted as corresponding to the average tension imposed on the warp during the weaving operation, and the frictional movement on the metal rod was performed on the assumption that it corresponded to friction with a heald at the weaving operation.

EXAMPLE 6

Figure 9:
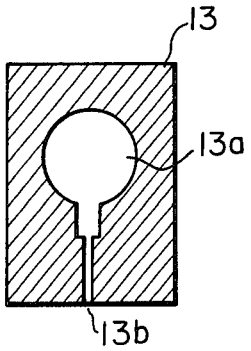
FIG. 9 is a cross-sectional view of the air jet interlacing nozzle of the apparatus shown in FIG. 8.
Figure 8:
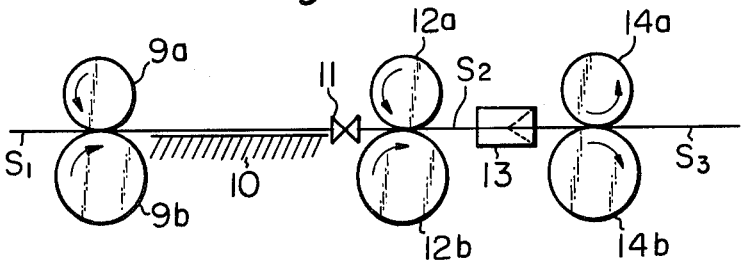
FIG. 8 is a schematic elevational view of the main portion of the apparatus for producing the interlaced yarn of the present invention.

Polyethylene terephthalate multifilament yarn was spun at a speed of 3000 m/min, and an oiling composition comprising a treating agent dissolved or dispersed in water at a concentration of 10% was applied to the yarn in a variable amount, according to a customary oil supply method, to obtain the undrawn yarn of $250d \times 48f$. The above-mentioned yarn was drawn at a draw ratio of 1.7 and a processing speed of 200 m/min, while false twisting it to impart 2400 twists per meter at a temperature indicated in Table 4 by using an apparatus as shown in FIG. 8. Subsequently, the yarn was sufficiently subjected to the interlacing treatment, by using a fluid treatment device 6 having a section as shown in FIG. 9, to obtain interlaced crimped yarn. The interlaced crimped yarn was taken-up so as to form a cheese package. The yarn packages were subjected to the conventional warping process. As already explained, the sizing of the warps was omitted. The woven fabric was produced by the water jet loom to obtain a grey fabric of a basket weave structure having a yarn density of 96 warps per inch and 88 wefts per inch. The same yarn as described above, except that the above-mentioned interlacing treatment was not conducted, was wound on a cheese and used as wefts. The weaving operation was carried out under a loom rotation of 360 r.p.m., and the amount of water sprayed was 4 ml per pick.

The possibility of omission of the scouring step was evaluated based on uneven dyeing and batch-to-batch variation observed when the resulting grey fabric was dried and directly dyed with Dianix Navy Blue ER-FS in the presence of a dispersant at a bath ratio of 1:30 and a dyeing temperature of 130° C for 60 minutes.

Formation of jet soils was evaluated based on the isolation state of the treating agent and the state of growth of fungi or molds observed when fabrics were woven at a rate of about 700 kg per beam.

The obtained results are shown in Table 4.

Table 4

| Run No. | Treating Agent | Heat Treatment Conditions | Isolation Ratio (%) Before heat treatment | Isolation Ratio (%) After heat treatment | Amount (% owf) of Isolated Treating Agent |
|---|---|---|---|---|---|
| 1 | A | 215° C ×0.39sec | 77.5 | 65.1 | 0.58 |
| 2 | A | 215° C ×0.39sec | 77.5 | 65.1 | 0.82 |
| 3 | A | 215° C ×0.39sec | 77.5 | 65.1 | 2.54 |
| 4 | A | 140° C ×0.05sec | 77.5 | 75.3 | 0.67 |
| 5 | B | 215° C ×0.39sec | 80.8 | 33.3 | 0.10 |
| 6 | B | 215° C ×0.39sec | 80.8 | 33.3 | 0.58 |
| 7 | C | 215° C ×0.39sec | 70.4 | 85.0 | 0.69 |

| Run No. | Residual Amount (% owf) of Treating Agent | Jet Soils | Dyeing Unevenness and Batch-to-Batch Variation | Remarks |
|---|---|---|---|---|
| 1 | 0.31 | good condition | good condition | present invention |
| 2 | 0.44 | bad condition | good condition | comparison |
| 3 | 1.36 | bad condition | bad condition | comparison |
| 4 | 0.22 | some problem | good condition | comparison |
| 5 | 0.19 | good condition | good condition | present invention |
| 6 | 1.10 | good condition | bad condition | comparison |
| 7 | 0.12 | bad condition | good condition | comparison |

Composition of Treating Agent

| Treating Agent A: | |
|---|---|
| trimethylol propane tricaprylate | 50 parts |
| n-butyl stearate | 15 " |
| sperm alcohol-$(EO)_3$ | 15 " |
| nonylphenol-$(EO)_4$ | 15 " |
| potassium lauryl phosphate | 5 " |

| Treating Agent B: | |
|---|---|
| mineral oil (100 seconds) | 70 parts |
| sperm alcohol-$(EO)_5$ | 15 " |
| sperm alcohol-$(EO)_8$ | 15 " |
| potassium lauryl phosphate | 5 " |

| Treating Agent C: | |
|---|---|
| pentaerythritol-ethylene oxide-propylene adduct (EO/total molecular weight = 35%, molecular weight = 2800) | 95 parts |

-continued

| Treating Agent C: | |
|---|---|
| potassium lauryl phosphate | 5 " |

Observations

Run No. 1 and No. 5:

The amount isolated was smaller than 0.6% owf and the residual amount was smaller than 1.0% owf. The scouring step could be conveniently omitted and no jet soils were formed.

Run No. 2:

Since the amount isolated was larger than 0.6% owf, jet soils were formed.

Run No. 3:

Both the amount isolated and the residual amount were too large and, hence, the scouring step could not be omitted and jet soils were formed.

Run No. 4:

The amount of the treating agent stuck to the fiber was the same as that in Run No. 1, but the heat treatment conditions did not satisfy the requirement of at least 160° C×0.1sec. Accordingly, the isolation ratio reducing effect was insufficient and the amount isolated was large. Therefore, formation of jet soils was observed.

Run No. 6:

Since the residual amount of the treating agent was too large, the scouring process could not be omitted.

Run No. 7:

Since the treating agent having a tendency that the isolation ratio was increased by the heat treatment was employed, formation of jet soils was observed.

EXAMPLE 7

Polyethylene terephthalate multifilament yarn was spun at a speed of 3000 m/min, and a treating agent indicated in Table 5 was applied to the yarns in a variable amount, according to a customary oil supplying method, to obtain undrawn yarn of 250 $d \times 48 f$. The above-mentioned yarn was drawn at a draw ratio of 1.7 and a processing speed of 200 m/min while false twisting it to impart 2400 twists per meter by using the apparatus shown in FIG. 8. Subsequently, in the apparatus shown in FIG. 8, the material multifilament yarn $S_1$ was supplied into the false twisting zone defined by a pair of supply rollers *9a*, *9b* and a pair of middle rollers *12a*, *12b*.

A conventional false twisting spindle 11 is disposed along a yarn passage in the false twisting zone at a position closer to the middle rollers *12a*, *12b* than the rollers *9a*, *9b*. A heater 10 is disposed adjacent to the rollers *12a*, *12b*, between the rollers *9a*, *9b* and the rollers *12a*, *12b*, along the yarn passage in the false twisting zone. Therefore, the yarn $S_2$ delivered from the middle rollers 12*a*, 12*b* is provided with false twists. A pair of delivery rollers 14*a*, 14*b* are disposed at a position downstream of the middle rollers 12*a*, 12*b*, and an interlacing air jet nozzle 13 is disposed along the yarn passage between the nip point of the middle rollers 12*a*, 12*b* and the nip point of the delivery rollers 14*a*, 14*b*. Therefore, the false twisted yarn $S_2$ is interlaced by the jet nozzle 13 so that the expected interlaced yarn $S_3$ is delivered from the delivery rollers 14*a*, 14*b*. The construction of the jet nozzle 13 is quite similar to the conventional one. As shown in FIG. 9, a space 13*a* having a round lateral cross-section is formed in the body of the nozzle 13 so as to provide a yarn passage. An inlet conduit 13*b* is connected to the space 13*a* in such a way that the longitudinal axis of the inlet conduit 13*b* is in line with the axial center of the space 13*a*. The air is jetted into the space 13*a* via the inlet conduit 13*b* so that a very effective interlacing treatment of the yarn $S_2$ can be carried out. Since such interlacing operation is well known, a detailed explanation of this interlacing operation is omitted. The interlaced yarn $S_3$ delivered from the delivery rollers 14*a*, 14*b* is taken-up so as to form a yarn package of cheese form.

The interlaced yarn was directly warped from the respective yarn packages and subjected to a weaving operation, without sizing, by using a water jet loom to obtain a grey fabric of a basket weave structure having a yarn density of 96 warps per inch and 88 wefts per inch. The same yarn as described above, except that the interlacing treatment was not conducted, was wound on a cheese and used as wefts. The weaving operation was carried out at a loom rotation of 360 rpm, and the amount of water sprayed was 4 ml per pick.

The possibility of omission of the scouring step was evaluated based on uneven dyeing and batch-to-batch variation observed when the resulting grey fabric was dried and directly dyed with Dianix Navy Blue ER-FS in the presence of a dispersant at a bath ratio of 1:30 and a dyeing temperature of 130° C for 60 minutes.

Formation of jet soils was evaluated based on the isolation state of treating agent and the state of growth of fungi and molds observed when fabrics were woven at a rate of about 700 Kg per beam.

The results obtained are shown in Table 5.

Table 5

| Run No. | Treating Agent | Isolation Ratio (%) before heat treatment | Isolation Ratio (%) after heat treatment | Amount (% owf) of Isolated Treating Agent |
|---|---|---|---|---|
| 1 | A | 70.4 | 85.0 | 0.34 |
| 2 | A | 70.4 | 85.0 | 0.73 |
| 3 | A | 70.4 | 85.0 | 6.86 |
| 4 | B | 80.8 | 33.3 | 0.58 |
| 5 | C | 30 | 28.1 | 0.34 |

| Run No. | Residual Amount (% owf) of Treating Agent | Jet Soils | Batch-to-Batch Variation and Unevenness Dyeing | Remarks |
|---|---|---|---|---|
| 1 | 0.06 | good condition | good condition | present invention |
| 2 | 0.13 | bad condition | good condition | comparison |
| 3 | 1.21 | bad condition | bad condition | comparison |
| 4 | 1.17 | good condition | bad condition | comparison |
| 5 | 1.37 | good condition | bad condition | comparison |

Composition of Treating Agent

| Treating Agent A: | |
|---|---|
| pentaerythritol-ethylene oxide-propylene oxide randam adduct (EO/total molecular weight = 35%, molecular weight = 2800) | 95 parts |
| potassium laury phosphate | 5 " |

| Treating Agent B: | |
|---|---|
| mineral oil (100 seconds) | 70 parts |
| sperm alcohol-$(EO)_5$ | 15 " |
| sperm alcohol-$(EO)_8$ | 15 " |
| potassium lauryl phosphate | 5 " |

| Treating Agent C: | |
|---|---|
| dioleyl phthalate | 50 parts |
| sperm alcohol-$(EO)_{12}$ | 23 " |
| oleic diglyceride | 7 " |
| potassium oleate | 5 " |

Observations

Run No. 1:
Since the amount isolated was smaller than 0.6% owf and the residual amount was smaller than 1% owf, the scouring step could be omitted and no jet soils were formed.

Run No. 2:
Since the isolated amount was larger than 0.6% owf, formation of jet soils were observed.

Run No. 3:
Since both the isolated amount and the residual amount were too large, the scouring step could not be omitted and formation of jet soils were observed.

Run No. 4 and No. 5:
Since the isolation ratio was reduced by the heat treatment in each of these runs, the residual amount of the treating agent was too large and the scouring step could not be omitted.

EXAMPLE 8

Polyethylene terephthalate multifilament yarn was spun at a speed of 3000 m/min, and a treating agent indicated in Table 6 was applied to the yarn in a variable amount, according to a customary oil supplying method, to obtain undrawn yarn of 250 $d \times 48 f$. The above-mentioned yarn was stretched at a draw ratio of 1.7 and a processing speed of 400 m/min while false twisting it to impart 2400 twists per meter by using the apparatus shown in FIG. 8. Subsequently, the yarns were subjected to the interlacing treatment by using the device 13 having a section as shown in FIG. 9, in the same way as Example 7, to obtain interlaced crimped yarn. The interlaced yarn was subjected to a taken-up operation so as to form cheese. The yarn was then directly warped and subjected to the weaving operation without sizing by using a water jet loom to obtain a grey fabric of a melon-amunzen structure having a yarn density of 82 warps per inch and 62 wefts per inch. The same yarn as described above, except that the interlacing treatment was not conducted, was produced and used as wefts. The weaving operation was carried out at a loom rotation of 360 rpm, and the amount of water sprayed was 4 ml per pick.

The possibility of omission of the scouring step was evaluated based on uneven dyeing and batch-to-batch variation observed when the resulting grey fabric was dried and directly dyed with Dianix Navy Blue ER-FS at a bath ratio of 1:30 and a dyeing temperature of 130° C for 60 minutes.

Formation of jet soils was evaluated based on the isolation state of the treating agent and the state of growth of fungi and molds observed when fabrics were woven at a rate of about 700 Kg per beam.

The obtained results are shown in Table 6.

Table 6

| Run No. | Treating Agent | Isolation Ratio (%) before heat treatment | Isolation Ratio (%) after heat treatment | Amount (% owf) of Isolated Treating Agent |
|---|---|---|---|---|
| 1 | A | 70.4 | 85.0 | 0.42 |
| 2 | A | 70.4 | 85.0 | 0.76 |
| 3 | A | 70.4 | 85.0 | 6.01 |
| 4 | B | 80.8 | 33.3 | 0.58 |
| 5 | C | 30.3 | 28.1 | 0.54 |

| Run No. | Residual Amount (% owf) of Treating Agent | Jet Soils | Uneven Dyeing and Batch-to-Batch Variation | Remarks |
|---|---|---|---|---|
| 1 | 0.08 | good condition | good condition | present invention |
| 2 | 0.15 | bad condition | good condition | comparison |
| 3 | 1.23 | bad condition | bad condition | comparison |
| 4 | 1.17 | good condition | bad condition | comparison |
| 5 | 1.37 | good condition | bad condition | comparison |

Composition of Treating Agent

| Treating Agent A: | |
|---|---|
| pentaerythritol-ethylene oxide-propylene oxide randam adduct (EO/total molecular weight = 35%, molecular weight = 2800) | 95 parts |
| potassium laury phosphate | 5 " |

| Treating Agent B: | |
|---|---|
| mineral oil (100 seconds) | 70 parts |
| sperm alcohol-$(EO)_5$ | 15 " |
| sperm alcohol-$(EO)_8$ | 15 " |
| potassium lauryl phosphate | 5 " |

| Treating Agent C: | |
|---|---|
| dioleyl phthalate | 50 parts |
| sperm alcohol-$(EO)_{12}$ | 23 " |
| oleic diglyceride | 7 " |
| potassium oleate | 5 " |

Observations

Run No. 1:

Since the amount isolated was lower than 0.6% owf and the residual amount was lower than 1.0% owf, the scouring step could be omitted and no jet soils were formed.

Run No. 2:

Since the amount isolated was larger than 0.6% owf, formation of jet soils was observed.

Run No. 3:

Since both the amount isolated and the residual amount were too large, the scouring step could not be omitted and formation of jet soils were observed.

Runs No. 4 and No. 5:

Since the isolation ratio of the treating agent used was reduced by the heat treatment, the residual amount of the treating agent was too large and the scouring step could not be omitted.

What is claimed is:

1. A process for producing a woven fabric from a false twisted, multifilament yarn by means of a power loom provided with healds and a reed, which comprises a first step of preparing an interlaced yarn for utilization as warp from a false twisted multifilament yarn made from a multifilament yarn without twist, in such a condition that the degree of interlacing of said inter laced multifilament yarn (CF value) is in a range between 100 and 260, a second step of carrying out a weaving operation by using said interlaced yarn without sizing as the warp by means of a power loom in such a condition that an average tension applied to said warp is in a range between 0.1 and 1.0 g/d, and each said warp contains water in at least 30 weight percent of said warp in a weaving zone between said healds and a cloth-fell defined by a beating motion of said reed.

2. A process for producing a woven fabric according to claim 1, wherein said power loom is a water jet loom.

3. A process for producing a woven fabric according to claim 2, wherein said multifilament yarn is provided with a treating agent characterized by an isolation ratio being capable of reducing by a heat treatment at least 160° C × 0.1 second, the amount of said treating agent isolated after said heat treatment being smaller than 0.6% owf and the residual amount of said treating agent after said heat treatment being smaller than 1.0% owf.

4. A process for producing a woven fabric according to claim 2, wherein said multifilament yarn is provided with a treating agent characterized by an isolation ratio being capable of increasinhg by a heat treatment, the amount of said treating agent isolated after said heat treatment being smaller than 0.6% owf and the residual amount of said treating agent after said heat treatment being smaller than 1.0%.

5. A process for producing a woven fabric according to claim 2, wherein said multifilament yarn is provided with a treating agent comprising at least 50% of at least one water soluble compound selected from the group consisting of ethylene oxide-propylene oxide randam adducts and/or ethylene oxide-propylene oxide randam copolymers, each having a molecular weight of at least 2500 in which the proportion of ethylene oxide units in the total molecular weight is 25 to 85% by weight, the amount of the treating agent isolated after a heat treatment of at least 160° C × 0.1 second is smaller than 0.6% owf and the residual amount of said treating agent after said heat treatment is smaller than 1.0% owf.

* * * * *